US008296866B2

(12) United States Patent
Kelly

(10) Patent No.: US 8,296,866 B2
(45) Date of Patent: Oct. 30, 2012

(54) SWEATBAND

(76) Inventor: Paula L. Kelly, Elburn, IL (US)

( * ) Notice: Subject to any disclaimer, the term of this patent is extended or adjusted under 35 U.S.C. 154(b) by 28 days.

(21) Appl. No.: 11/435,074

(22) Filed: May 16, 2006

(65) Prior Publication Data

US 2007/0044204 A1 Mar. 1, 2007

Related U.S. Application Data

(60) Provisional application No. 60/681,765, filed on May 16, 2005, provisional application No. 60/686,898, filed on Jun. 2, 2005.

(51) Int. Cl.
*A42B 1/00* (2006.01)

(52) U.S. Cl. ..... 2/181; 2/174; 2/DIG. 11

(58) Field of Classification Search ..... 2/170, 171, 2/172, 174, 181, 181.1, 181.2, 182.1–182.8, 2/162; 132/212
See application file for complete search history.

(56) References Cited

U.S. PATENT DOCUMENTS

| | | | | |
|---|---|---|---|---|
| 1,750,937 | A * | 3/1930 | Morgan | 4/521 |
| 2,320,782 | A * | 6/1943 | Larsen | 2/171 |
| 2,330,782 | A * | 9/1943 | Morelock | 338/195 |
| 2,331,545 | A * | 10/1943 | Gano, Jr. | 2/181 |
| 4,481,680 | A * | 11/1984 | Mason et al. | 2/174 |
| 4,638,512 | A * | 1/1987 | Frankel | 2/171 |
| 5,781,932 | A * | 7/1998 | Brown | 2/181 |
| 6,353,936 | B2 * | 3/2002 | Flatt | 2/181 |
| 6,546,601 | B1 * | 4/2003 | Kawashima | 24/200 |
| 6,584,984 | B2 * | 7/2003 | Kelly | 132/212 |
| 2003/0172445 | A1 * | 9/2003 | Kawashima | 2/452 |

* cited by examiner

*Primary Examiner* — Khoa Huynh
*Assistant Examiner* — Richale Quinn
(74) *Attorney, Agent, or Firm* — L.C. Begin & Associates, PLLC.

(57) ABSTRACT

A flexible, non-absorbent sweatband includes a seal band sized to wrap around a wearer's head and a clip into which the free ends of the seal band are secured at the back of the wearer's head. An upwardly opening channel is integrally molded with the seal band to carry sweat dripping down the wearer's forehead to open channel ends behind the wearer's ears.

5 Claims, 4 Drawing Sheets

12
14
16
18
20
20A
22
24
26
28
30
32
32A

SWEATBAND

CROSS-REFERENCES TO RELATED APPLICATIONS

This application claims priority to U.S. Provisional Patent Application Ser. No. 60/681,765, filed May 16, 2005, and U.S. Provisional Patent Application Ser. No. 60/686,898, filed Jun. 2, 2005.

INCORPORATION-BY-REFERENCE OF MATERIAL SUBMITTED ON A COMPACT DISC

Not Applicable.

STATEMENT REGARDING FEDERALLY SPONSORED RESEARCH OR DEVELOPMENT

Not Applicable.

BACKGROUND OF THE INVENTION

1. Field of Invention

The present invention relates to a band to prevent sweat from dripping from a wearer's forehead into his or her eyes and onto his or her face.

More particularly, the invention relates to an adjustable-size sweatband with an integrally formed channel to catch sweat dripping down a wearer's forehead and direct it to behind the wearer's ears.

2. Background Art

Sweatbands currently on the market are made of a stretchy cotton and polyester material. The band becomes saturated with sweat making it uncomfortable to wear and functional for only a short period of time. After the band becomes saturated with sweat, it must be taken off and wrung out or replaced with a dry sweatband.

The present invention addresses these and other drawbacks and disadvantages or prior sweatbands.

SUMMARY OF THE INVENTION

The general objective of the present invention is to provide a new and improved band to prevent dripping of sweat from the forehead into the wearer's eyes and onto the wearer's face.

The sweatband of the present invention is molded of a soft, pliable silicone or urethane type material (i.e., silicone or urethane based composition or other molded material with similar soft, pliable characteristics). The band does not absorb sweat and can be worn comfortably for hours. Sweat collects in a channel in the band and runs off behind the ears making the band much more comfortable to wear for hours on end. There is a clasp at the back of the head where the band can be adjusted for a comfortable fit for any size head, both youth and adult.

Uses for the sweatband include: sporting activities such as basketball, baseball, volleyball, soccer, tennis, golf, football; gym workouts, racquetball, running, bicycling; military applications for troops in the field; construction workers; road crews; utility crews; and safety suiting environments. The sweatband can be worn alone or, for example, under or just below: baseball caps; construction workers hard hats or other protective helmets.

These and other objectives and advantages of the invention will become more apparent from the following detailed description when taken in conjunction with the accompanying drawings.

Briefly, a sweatband in accordance with the invention, configured for wrapping around a wearer's head, includes a seal band and a clasp. The seal band is molded from a soft, pliable, non-absorbent rubber composition to conform to the shape of the wearer's head. The seal band includes an elongated base band to wrap around the wearer's head, the base band having a continuously extending center length for wrapping along the wearer's forehead and a corresponding inside surface to seal against the wearer's forehead, and having terminating free ends for positioning at the back of the wearer's head. The seal band further having an integrally molded upwardly opening channel on the outside of the base band to catch sweat as it drips down the wearer's forehead and carry the sweat to behind the wearer's ears; the channel extending continuously lengthwise along the center length of the base band and terminating in open ends proximate the free ends of the base band for positioning behind the wearer's ears. The clasp is molded from a material stiffer than the seal band, and is provided with slots slidably receiving the terminating free ends of the base band for adjustably securing the headband onto the wearer's head.

Figure 1:
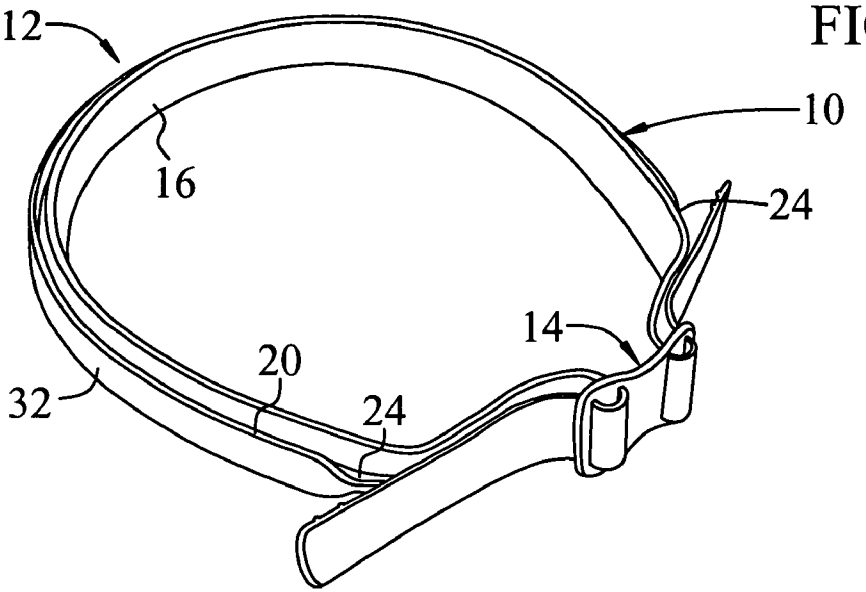
FIGS. 1, 1A, 2 and 2A are perspective views of a preferred embodiment sweatband incorporating the unique aspects of the present invention.
Figure 2:
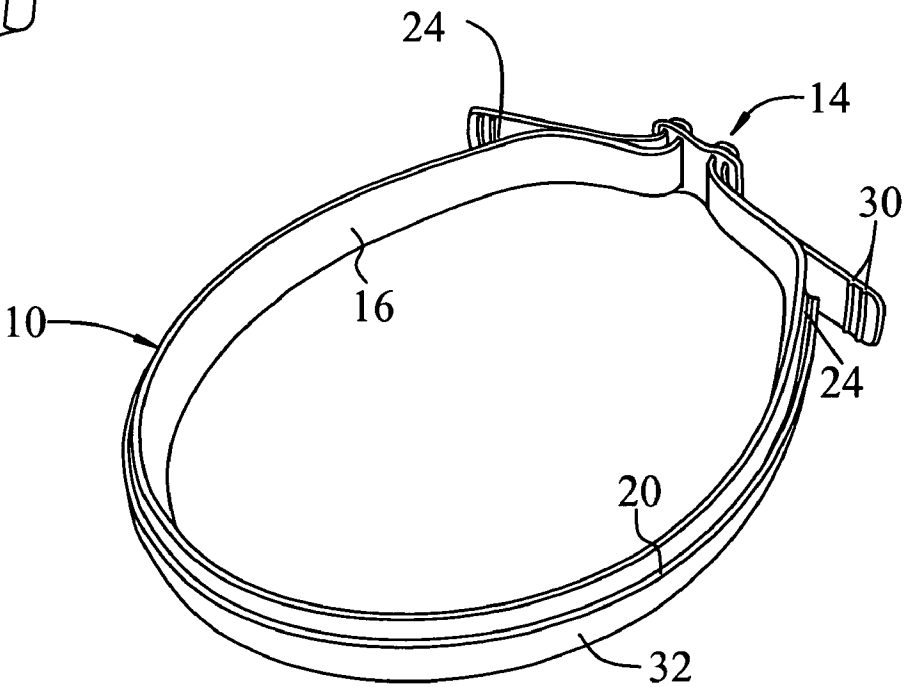
Figure 1A:
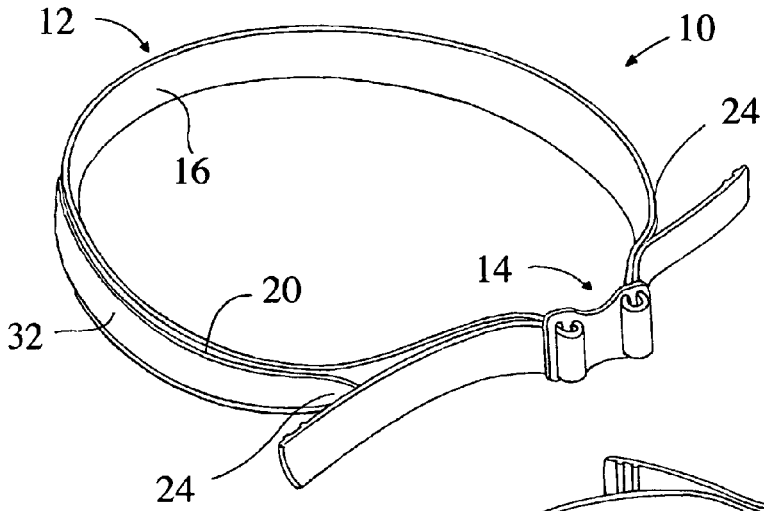
Figure 2A:
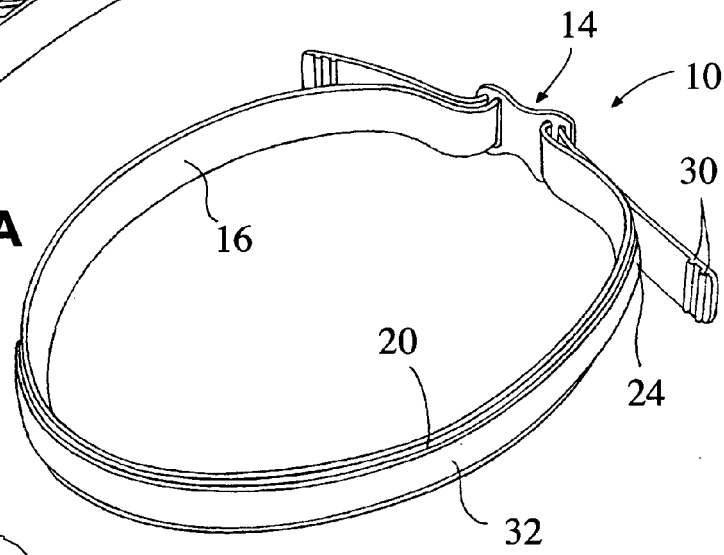

While the invention is susceptible of various modifications and alternative constructions, a certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE INVENTION

For purposes of illustration, the present invention is shown in the drawings as sweatband 10 (FIGS. 1, 1A, 2 and 2A).

The sweatband 10 includes a seal band 12 and a clip or clasp 14 (FIGS. 10-13).

Figure 3A:
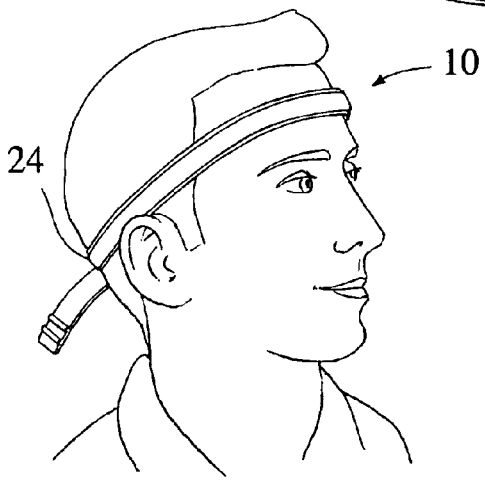
FIGS. 3, 3A and 4 are views showing the sweatband in use.
Figure 3:
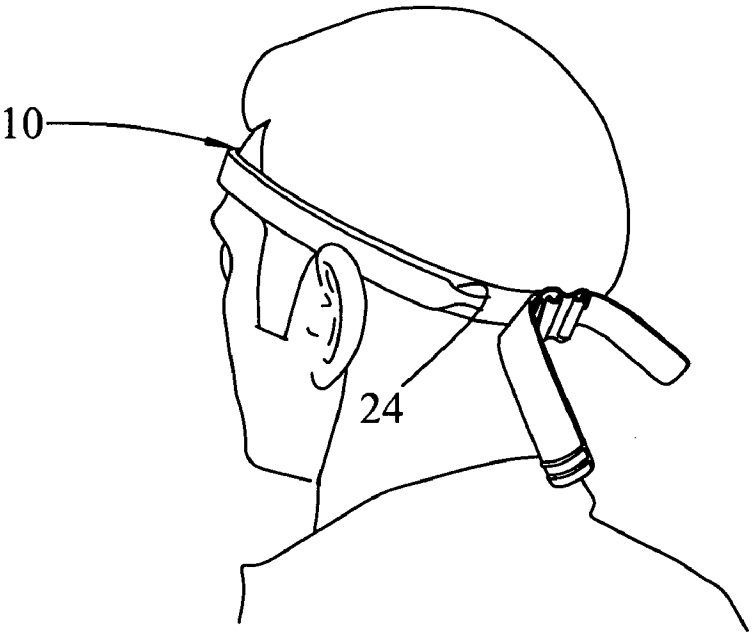
Figure 4:
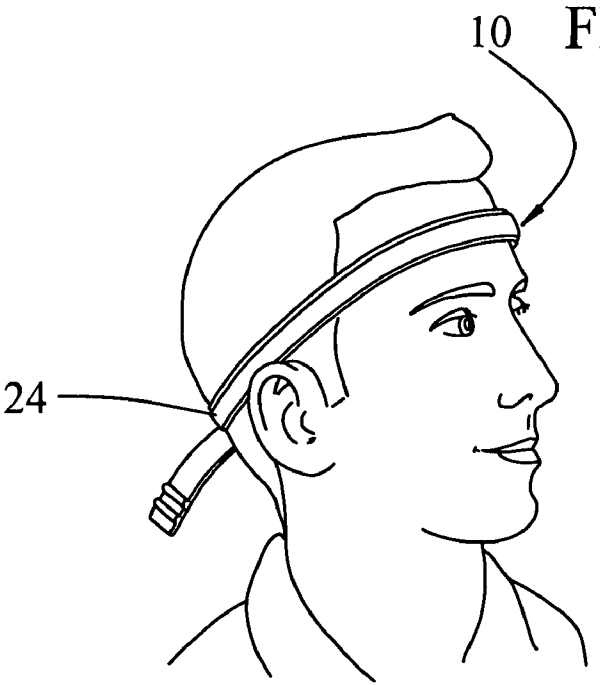
Figures 5, 6, 7, 8, 9, 10, 11, 12, 13:
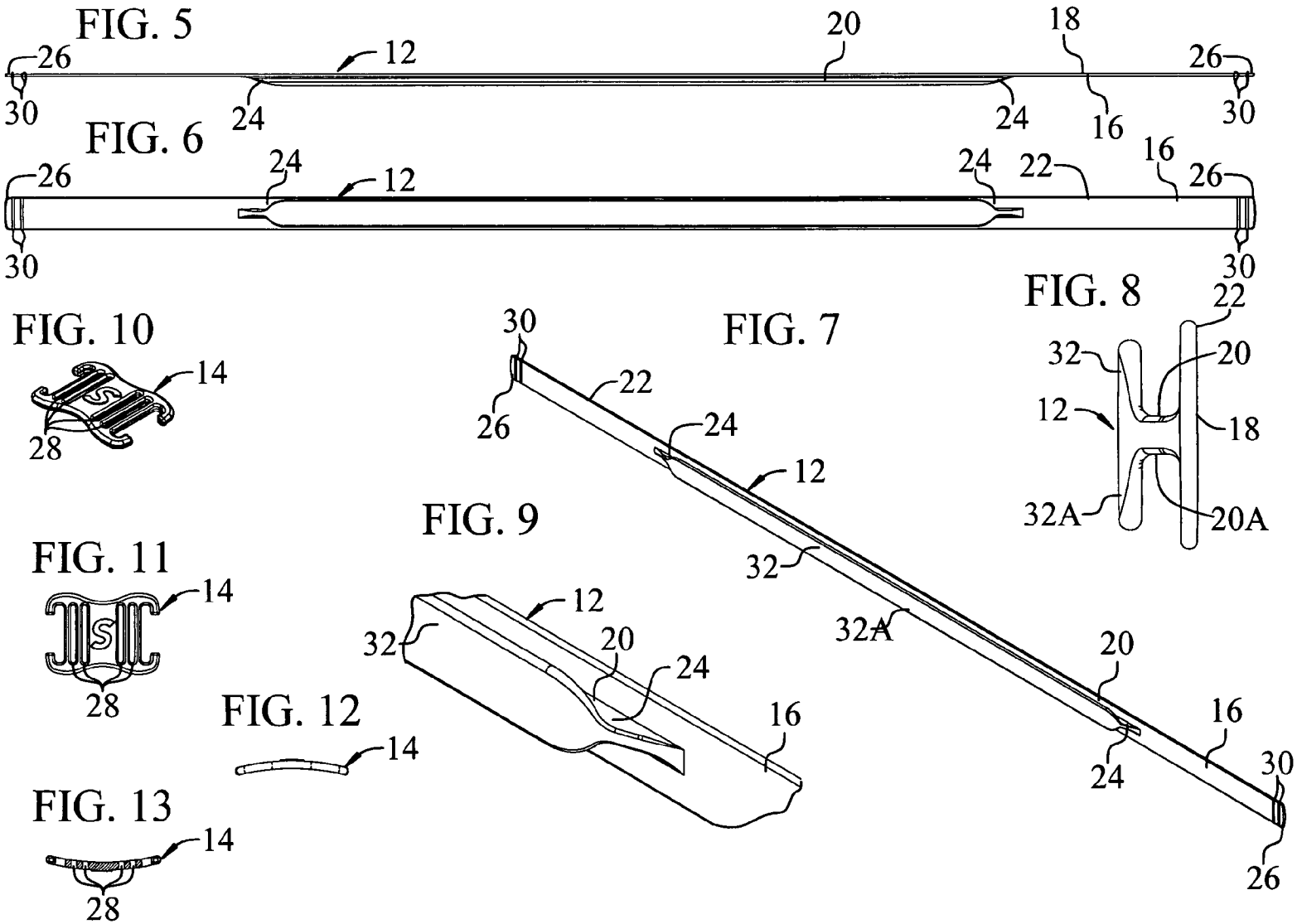
FIGS. 5-7 are top, front and perspective views of the band in a straight condition.
FIG. 8 in an enlarged end view of the band.
FIG. 9 is an enlarged fragmentary perspective view of a portion of the band.
FIGS. 10-12 are perspective, back and bottom views of the clasp for the ends of the bands.
FIG. 13 is a cross-section of the clasp taken through the center of the view shown in FIG. 11.

The seal band 12 is molded from a soft, resilient, durable, lightweight, non-absorbent silicone or urethane type rubber material (i.e., silicone or urethane based composition or other molded rubber material with similar soft, pliable, non-absorbent characteristics) to wrap around and conform to the shape of the wearer's head (FIGS. 3, 3A and 4). The clip 14 is molded from a firmer material, such as a stiffer silicone or urethane type material or from a plastic material.

The seal band 12 includes an elongated base band 16 to wrap around the wearer's head and seal against the wearer's forehead, and an integrally molded upwardly opening channel 20 defined between the base band and an outer web 32 to catch sweat as it drips down the wearer's forehead and carry the sweat to behind the wearer's ears.

The base band 16 provides a smooth inside surface 18 to establish a continuous seal against the wearer's forehead, such as with an inwardly facing upper sealing edge 22.

The preferred base band 16 is generally rectangular in cross-section (such as when viewed from the end as in FIG. 8) to preferably establish a substantially constant thickness band having a width across the forehead (as in contact with the forehead via surface 18) that is greater than the thickness of the band, but in all embodiments, the cross-section of the base band will be established to provide desired flexibility and sealing engagement with the wearer's forehead.

The channel 20 is positioned outwardly of the sealing edge 22, and extends continuously lengthwise along the center length of the base band 16 to wrap around the wearer's forehead and extend to behind both ears (see FIGS. 3-4). The channel terminates in open ends 24 located on the base band proximate the free ends thereof for positioning behind the wearer's ears. The ends of the channels are preferably angled or tapered such as shown in detail in FIG. 9 for convenience of molding of the band.

The clip 14 shown includes two slots 28 to slidably receive each of the terminating fee ends 26 of the base band and is provided with a convenient configuration for adjustably securing the headband onto the wearer's head (FIGS. 3-4). The preferred clip is conformable with the back of the wearer's head and/or is provided with a pre-formed curvature therefor (see FIGS. 12-13). The preferred clip further includes outer open slots 28A into which the free ends of the base band can be quickly clipped to redirect the free ends rearwardly and reduce free movement thereof while the band is in use. Alternate configuration clips or clasps that enable adjustment of the band on the wearer's head may be used with the sweatband 10.

In the preferred embodiment, the ends of the band are provided with small indentations or grooves 30 to enable ease of initially sliding the ends through the slots in the clasp as well as for decorative effect. Alternately, small protrusions 30A shown in FIGS 1A, 2A may be provided at the ends of the bands for gripping convenience.

With the sweatband 10 in position on the wearer's head, the channel 20 is inclined downwardly from the wearer's forehead towards (but above) the wearer's ears to carry sweat dripping into the channel to past the wearer's ears and then drop out of the open ends 24 of the channel behind the ears where it will not inconvenience the wearer.

The preferred sweatband 10 is symmetric, with an upwardly opening channel 20 and a downwardly opening channel 20A established behind integrally molded web 32A, so that the band is reversible, and it can be put on with either channel opening up, and thus without concern for which side is the top of the band. All other aspects of the channel 20 described above are mirrored or reproduced in channel 20A As previously noted, the sweatband is molded from urethane, silicone or similar type materials. In certain embodiments, a urethane material is preferred for its slightly more rigid characteristics. Since urethane is typically not used for large production quantities, a material of similar characteristics from the Dynaflex® thermoplastic elastomers provides a suitable alternate material. Other material compositions will be selected or specified by those skilled in the art for particular purposes.

I claim:

1. A sweatband for wrapping around a wearer's head, the sweatband comprising:

a) a seal band molded from a soft, pliable, non-absorbent rubber composition to conform to the shape of the wearer's head; the seal band having:

a) an elongated base band with terminating free ends, the base band being of continuously integral unitary molded construction along its entire length between said terminating free ends, the base band being sized to wrap lengthwise entirely around the wearer's head wherein said terminating free ends are separable from one another and are sized to overlap one another at the back of the wearer's head, the base band having a continuously extending outside surface between said terminating ends, the base band having a continuously extending upper edge between said terminating free ends, the base band having a continuously extending center length for wrapping along the wearer's forehead to behind the wearer's ears, the base band having an inside surface corresponding to said center length and extending to seal against the wearer's forehead and to behind the wearer's ears; and b) an upwardly opening channel that is integrally molded on the outside of the base band to catch sweat as it drips down the wearer's forehead and carry the sweat to behind the wearer's ears;

the upwardly opening channel extending continuously lengthwise along the center length of the base band and terminating in open ends proximate the free ends of the base band for positioning behind the wearer's ears;

the channel including a first portion extending perpendicularly from the base band outside surface, wherein the channel first portion angles toward the outside surface proximate the open ends of the channel, to blend into the outside surface

2. The sweatband as defined in claim 1 further comprising a clasp for adjustably securing the sweatband onto the wearer's head, the clasp including closed slots and open slots structured for receiving the free ends of the base band therethrough, wherein the clasp is structured such that each free end passes through one of the closed slots prior to passing into any of the open slots, and wherein the open slots are structured to hold the free ends of the base band after the free ends are inserted therein.

3. The sweatband as defined in claim 1 further comprising a downwardly opening channel integrally molded on the outside of the base band symmetric with respect to the upwardly opening channel.

4. The sweatband as defined in claim 3 further comprising a clasp for adjustably securing the sweatband onto the wearer's head, the clasp including closed slots and open slots structured for receiving the free ends of the base band therethrough, wherein the clasp is structured such that each free end passes through one of the closed slots prior to passing into any of the open slots, and wherein the open slots are structured to hold the free ends of the base band after the free ends are inserted therein.

5. A sweatband for wrapping around a wearer's head, the sweatband comprising:

a) a seal band molded from a soft, pliable, non-absorbent silicone or urethane composition to conform to the shape of the wearer's head; the seal band having:

a) an elongated base band with terminating free ends, the base band being of continuously integral unitary molded construction along its entire length between said terminating free ends, the base band being sized to wrap lengthwise entirely around the wearer's head wherein said terminating free ends are separable from one another and are sized to overlap one another at the back of the wearer's head, the base band having a continuously extending outside surface between said terminating ends, the base band having a continuously extending upper edge between said terminating free ends, the base band having a continuously extending center length for wrapping along the wearer's forehead to behind the wearer's ears, the base band having an inside surface corresponding to said center length and extending to seal against the wearer's forehead and to behind the wearer's ears; and b) an upwardly opening channel that is integrally molded on the outside of the base band to catch sweat as it drips down the wearer's forehead and carry the sweat to behind the wearer's ears; the upwardly opening channel extending continuously lengthwise along the center length of the base band and terminating in open ends proximate the free ends of the base band for positioning behind the wearer's ears;

c) a downwardly opening channel that is integrally molded on the outside of the base band, the downwardly opening channel mirroring the upwardly opening channel with respect the end length thereof; and b) a clasp molded with a curvature for conformance with the back of the wearer's head; the clasp including closed slots and open slots structured for receiving the free ends of the base band therethrough, wherein the clasp is structured such that each free end passes through one of the closed slots prior to passing into any of the open slots, and wherein the open slots are structured to hold the free ends of the base band after the free ends are inserted therein; and wherein the channel includes a first portion extending perpendicularly from the base band outside surface, wherein the channel first portion angles toward the outside surface proximate the open ends of the channel, to blend into the outside surface proximate the open ends of the channel.

* * * * *